US006972398B2

(12) United States Patent
Kang

(10) Patent No.: US 6,972,398 B2
(45) Date of Patent: Dec. 6, 2005

(54) WALL MOUNTED TYPE MICROWAVE OVEN

(75) Inventor: Jeon Hong Kang, Yongin-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/885,798

(22) Filed: Jul. 8, 2004

(65) Prior Publication Data

US 2005/0127070 A1 Jun. 16, 2005

(30) Foreign Application Priority Data

Dec. 10, 2003 (KR) ..... 2003-89776

(51) Int. Cl.[7] ..... H05B 6/80

(52) U.S. Cl. ..... 219/757; 219/681; 126/21 A; 126/299 R

(58) Field of Search ..... 219/757, 681, 219/756, 400, 686, 683, 702; 126/21 A, 21 R, 126/39 R, 110 R, 229 R, 229 D, 237 R, 126/273 R, 190; 312/296

(56) References Cited

U.S. PATENT DOCUMENTS 6,509,556 B2 * 1/2003 Kim ..... 219/757
6,621,057 B2 * 9/2003 Kim ..... 219/757
6,864,472 B2 * 3/2005 Kang ..... 219/757

FOREIGN PATENT DOCUMENTS

KR 2002-57117 7/2002

* cited by examiner

*Primary Examiner*—Quang T. Van
(74) *Attorney, Agent, or Firm*—Staas & Halsey LLP

(57) ABSTRACT

A wall mounted type microwave oven to efficiently cool a driving motor to couple an exhaust fan and a cooling fan includes an oven cabinet having air inlets and an exhaust outlet. the cooling fan and the driving motor are isolated from the exhaust fan communicating with the exhaust outlet, and communicate with the air inlet by a first partition plate of a guide unit. The driving motor is disposed between first and second brackets, which hold the exhaust fan casing and the cooling fan casing and, respectively, have center openings. Air is directed to the driving motor and introduced into the exhaust fan and the cooling fan through gaps while cooling the driving motor.

16 Claims, 3 Drawing Sheets

WALL MOUNTED TYPE MICROWAVE OVEN

CROSS-REFERENCE TO RELATED APPLICATION

This application claims the benefit of Korean Patent Application No. 2003-89776, filed Dec. 10, 2003 in the Korean Intellectual Property Office, the disclosure of which is incorporated herein by reference.

BACKGROUND OF THE INVENTION

1. Field of the Invention

The present invention relates a wall mounted type microwave oven, and more particularly, to a wall mounted type microwave oven which is provided with an exhaust and cooling unit having a driving motor and an exhaust fan and a cooling fan coupled to driving shafts projected from opposite ends of the driving motor so as to perform an operation of discharging exhaust gas as well as an operation of cooling electrical components, by a single driving motor.

2. Description of the Related Art

A conventional wall mounted type microwave oven is generally installed over an oven range placed on kitchen appliances in a kitchen, and serves to perform an operation of discharging exhaust air, smoke and food odors, generated from other cooking apparatuses, to an outside of a dwelling, as well as an operation of cooking food by high frequency electromagnetic waves in a conventional microwave oven.

The conventional wall mounted type microwave oven includes an oven cabinet forming an appearance as in the conventional microwave oven, which is provided with a cooking chamber to cook foods therein, and an electrical component compartment to house various electrical components. The cooking chamber and the electrical component compartment are isolated from each other by a partition plate. The wall mounted type microwave oven further includes an exhaust path defined between the cooking chamber and the oven cabinet, and an exhausting unit provided at a rear, upper portion of the oven cabinet and connected to the exhaust path, so as to draw exhaust gas and food odors generated from other cooking apparatuses installed below the oven cabinet through the exhaust path and discharge the exhaust gas and the food odors to the outside of a dwelling.

The exhausting unit includes a driving motor and a pair of exhaust fans coupled to two driving shafts projected from opposite ends of the driving motor, to exhaust the gas and food odors generated from the other cooking apparatuses from cooking operations, to the outside of the dwelling, and/or to discharge the exhaust gas and food odors to the kitchen after filtering the exhaust gas and food odors.

The wall mounted type microwave oven further includes an air inlet, an exhaust outlet and an air outlet provided at an upper portion of a front face thereof. The air inlet allows indoor air to be supplied to the electrical components compartment therethrough, the exhaust outlet allows exhaust gas, which is discharged from the exhaust fans and filtered, to be discharged in a forward direction from the oven cabinet therethrough, and the air outlet allows air, which passed through the electrical component compartment and the cooking chamber, to be discharged from the oven cabinet in the forward direction therethrough.

The electrical component compartment is provided with a cooling fan to draw the indoor air into the electrical component compartment through the air inlet, to supply the drawn indoor air to the cooking chamber, and further to discharge the supplied indoor air from the oven cabinet through the air outlet. The air inlet, the air outlet and the exhaust outlet are separated from each other by partition plates provided between a top wall of the cooking chamber and the oven cabinet, thereby preventing the drawn air, the air to be discharged and the exhaust gas from mixing with each other.

Because the driving motor drives the pair of exhaust fans and generates heat during an operation thereof, an additional air path must be provided in the microwave oven to cool the driving motor.

In the conventional wall mounted type microwave oven, the driving motor and the pair of exhaust fans coupled to the two ends of the driving motor are disposed to a rear, upper portion of the oven cabinet, and the air inlet, the air outlet and the exhaust outlet, which are separated from each other by the partition plates, are disposed to a front and upper portion of the oven cabinet. Accordingly, since the air path to circulate air drawn by the driving motor is a complicated structure, the driving motor cannot be efficiently cooled. Thus, components of the driving motor must endure high temperatures, thereby causing a size of the driving motor to be relatively enlarged, compared to a capacity required to drive the pair of exhaust fans.

SUMMARY OF THE INVENTION

Accordingly, it is an aspect of the present invention to provide a wall mounted type microwave oven, which efficiently cools a driving motor to which an exhaust fan and a cooling fan are coupled.

Additional aspects and/or advantages of the invention will be set forth in part in the description which follows and, in part, will be obvious from the description, or may be learned by practice of the invention.

The above and/or other aspects are achieved by providing a wall mounted type microwave oven including an oven cabinet with an exhaust path, a driving motor disposed at an upper portion of the oven cabinet, an exhaust fan coupled to a first end of the driving motor and disposed in the exhaust path, a cooling fan coupled to a second end of the driving motor, an exhaust outlet disposed to the upper portion of the oven cabinet to allow exhaust gas discharged from the exhaust fan to be discharged to an outside of the oven cabinet, an air inlet disposed at the upper portion of the oven cabinet to allow air to be drawn by the cooling fan, and a guide unit to isolate the exhaust fan and the exhaust outlet from the cooling fan and the air inlet and to position the driving motor and the cooling fan at an air inlet side.

The guide unit may include a first partition plate extending from between the air inlet and the exhaust outlet to between the driving motor and the exhaust fan to define a cooling path communicating the air inlet with the driving motor and the cooling fan and to define an exhaust path communicating the exhaust outlet with the exhaust fan.

The air inlet may be positioned at one side of the exhaust outlet while the air outlet may be positioned at another side of the exhaust outlet.

The guide unit may further include a rear plate extending from a rear end of the first partition plate toward a side panel of the oven cabinet adjacent to the exhaust path, a second partition plate extending from between the air outlet and the exhaust outlet to a rear plate, and a third partition plate extending from between the exhaust path and the air outlet to the rear plate.

The rear plate may include an opening at a region corresponding to the exhaust fan, to allow exhaust gas discharged from the exhaust fan to be directed to the exhaust outlet.

First and second brackets may be provided at opposite ends of the driving motor, each of which has a plurality of bosses extending toward the driving motor, each of the bosses having a threaded hole, and the driving motor may include a plurality of screw holes at an outer surface thereof, which are aligned with the threaded holes of the bosses and through which screws are screwed into the threaded holes of the bosses of the first and second brackets, thereby spacing the first and second brackets from the driving motor by predetermined intervals.

A first casing surrounding the exhaust fan and a second casing surrounding cooling fan may be secured to the outer surfaces of the first and second brackets, respectively.

Each of the first and second brackets may include a center opening such that a gap is formed between an edge of the opening and the driving motor, whereby during rotations of the exhaust fan and the cooling fan, air is introduced into the exhaust fan and the cooling fan through gaps while cooling the driving motor.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENT

Figure 1:
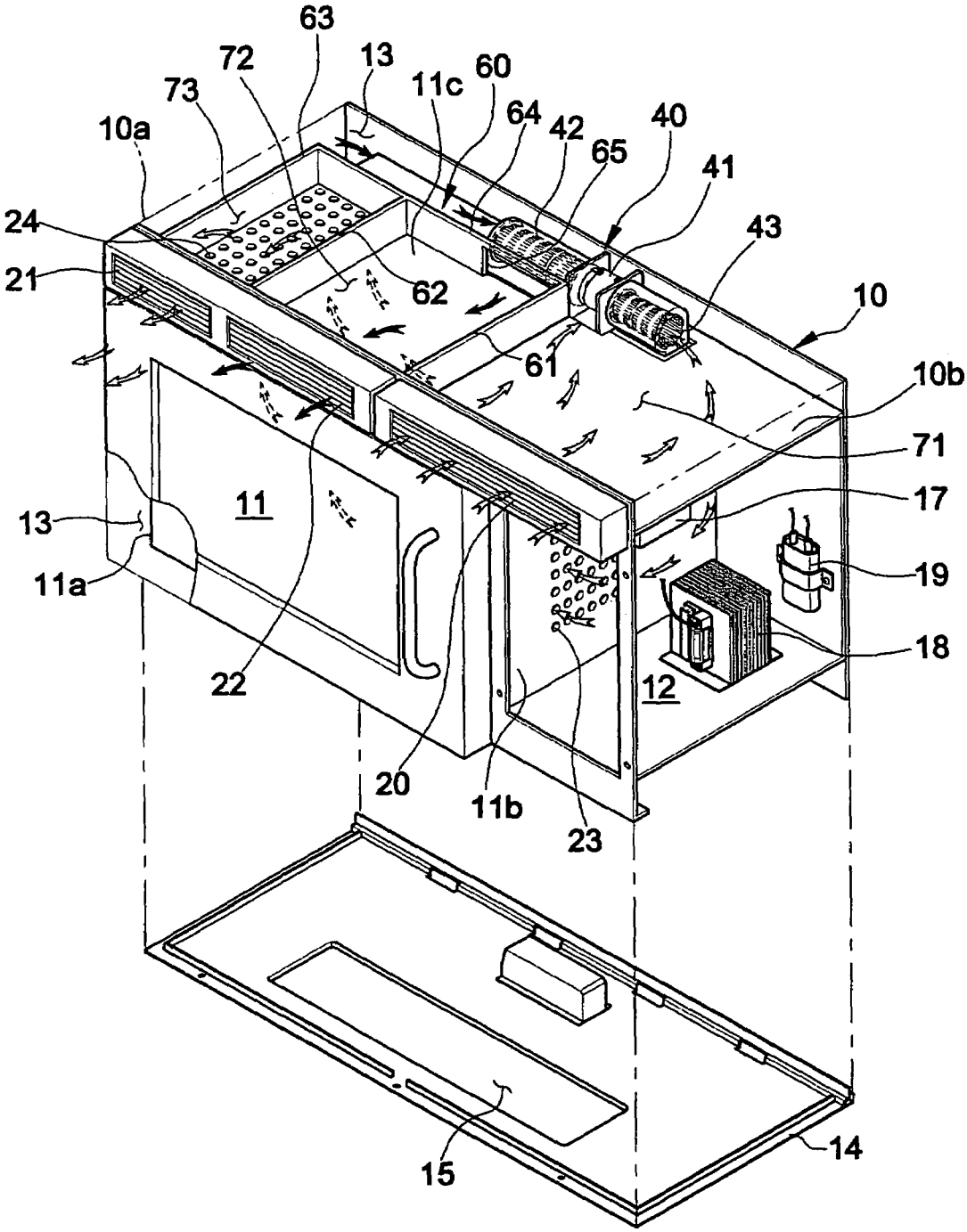
FIG. 1 is a perspective view of a wall mounted type microwave oven according to an embodiment of the present invention, in which an exhaust path is isolated from a cooling path.

Reference will now be made in detail to the embodiment of the present invention, examples of which are illustrated in the accompanying drawings, wherein like reference numerals refer to like elements throughout.

FIG. 1 is a perspective view of a wall mounted type microwave oven according to an embodiment of the present invention, in which an exhaust path 13 and a cooling path 71 are separated from each other. As shown in FIG. 1, the wall mounted type microwave oven includes a box-shaped oven cabinet 10, and a cooking chamber 11 and an electrical component compartment 12 which are provided in the oven cabinet to be separated from each other.

The box-shaped oven cabinet 10 is provided at a lower surface thereof with a hood 14 having an intake opening 15, so that, for example, exhaust gas and smoke generated from other cooking apparatuses such as a gas oven range (not shown) by a cooking operation thereof are introduced into the box-shaped oven cabinet 10 through the intake opening 15. The exhaust path 13 is provided between a left panel 10*a* of the box-shaped oven cabinet 10 and a left plate 11*a* of the cooking chamber 11 so as to allow the exhaust gas introduced through the intake opening 15 of the hood 14 to be directly exhausted to an outside of a room and/or to be filtered and discharged to the room.

An air inlet 20 and an air outlet 21 are provided at front, upper portions of the electrical component compartment 12 and the cooking chamber 11, respectively. An exhaust outlet 22 is disposed between the air inlet 20 and the air outlet 21. A right plate 11*b*, which isolates the cooking chamber 11 from the electrical component compartment 12, includes a plurality of through-holes 23, and a top plate 11*c* of the cooking chamber 11 includes a plurality of through-holes 24.

The top plate 11*c* of the cooking chamber 11, which serves as a common ceiling of the cooking chamber 11 and the electrical component compartment 12, is provided with a guide unit 60 thereon. The guide unit 60 isolates the air inlet 20, the air outlet 21 and the exhaust outlet 22 from each other, thereby guiding suction and a discharge of the air and a discharge of the exhaust gas separately. An exhaust and cooling unit 40 is disposed in a rear of the guide unit 60, which operates to draw and to discharge the exhaust gas as well as to blow the air toward the electrical component compartment 12 and the cooking chamber 11.

The exhaust and cooling unit 40 includes a driving motor 41, and an exhaust fan 42 and a cooling fan 43 coupled to opposite ends of the driving motor 41.

The exhaust fan 42 is positioned in the exhaust path 13, and the cooling fan 43 is positioned at the electrical component compartment 12 to introduce the air, drawn through the air inlet 20, into the electrical component compartment 12, thereby cooling electrical components, such as a magnetron 17, a high voltage transformer 18 and condenser 19, which are located in the electrical component compartment 12.

The guide unit 60 includes a first partition plate 61 extending from between the air inlet 20 and the exhaust outlet 22 to between the driving motor 41 and the exhaust fan 42, a rear plate 64 extending from a rear end of the first partition plate 61 positioned between the driving motor 41 and the exhaust fan 41 to the left panel 10*a* of the box-shaped oven cabinet 10 adjacent to the exhaust path 13, a second partition plate 62 extending from between the air outlet 21 and the exhaust outlet 22 to the rear plate 64, and a third plate 63 extending from between the exhaust path 13 and the air outlet 21 to a left end of the rear plate 64.

By the configuration of the guide unit 60, the cooling path 71 is defined between the first partition plate 61 and a right panel 10*b* of the box-shaped oven cabinet 10 to guide the air, drawn through the air inlet 20 by the cooling fan 43, to the electrical component compartment 12. Further, by the configuration of the guide unit 60, a first exhaust path 72 is defined between the first partition plate 61 and the second partition plate 62 to guide the exhaust gas, discharged from the exhaust fan 42, toward the exhaust outlet 22, and a second exhaust path 73 is defined between the second partition plate 62 and the third partition plate 63 to guide the air, discharged from the cooking chamber 11, toward the air outlet 21.

The driving motor 41 and the cooling fan 43 are positioned in a rear region of the cooling path 71 defined by the first partition plate 61 of the guide unit 60, so that the air drawn through the air inlet 20 is directly supplied to the driving motor 41 and then discharged therefrom. Thus, the driving motor 41 is efficiently cooled by the air passing therethrough.

The rear plate 64 includes an opening 65 at a region corresponding to the exhaust fan 42 so as to allow the exhaust gas discharged from the exhaust fan 42 to be directed to the exhaust outlet 22 through the first exhaust path 72. The wall mounted type microwave oven may include a filter (not shown) provided at an inner side of the exhaust outlet 22 to absorb the exhaust gas and the food odors.

When the driving motor 41 operates, the exhaust gas and smoke are introduced into the exhaust path 13 through the intake opening 15 of the hood 14, and are discharged from the exhaust outlet 22 through the exhaust fan 42, the opening 65 of the rear plate 64 and the first exhaust path 72 by a suction force of the exhaust fan 42. In this case, the exhaust gas may be exhausted to the outside of the room through an exhaust duct (not shown) connected to an upper or rear portion of the box-shaped oven cabinet 10.

When food is cooked in the cooking chamber 11, the air drawn through the air inlet 20 is introduced into the electrical component compartment 12 through the cooling path 71 by a suction force of the cooling fan 43 to cool the electrical components such as the magnetron 17 thereby. Subsequently, the air in the electrical component compartment 12 is introduced into the cooking chamber 11 through the plurality of through-holes 23 to eliminate moisture and the food odors in the cooking chamber 11 and the air introduced into the cooking chamber 11 is discharged to the room through the plurality of through-holes 24, the second exhaust path 73 and the air outlet 21.

As described above, while the exhaust fan 42 and the cooling fan 43 operate, air, which is introduced into the cooling path 71 through the air inlet 20, passes through the driving motor 41 while cooling the driving motor 41. A configuration, which enables the air to pass through the driving motor 41, will now be described with reference to FIGS. 2 and 3.

Figure 2:
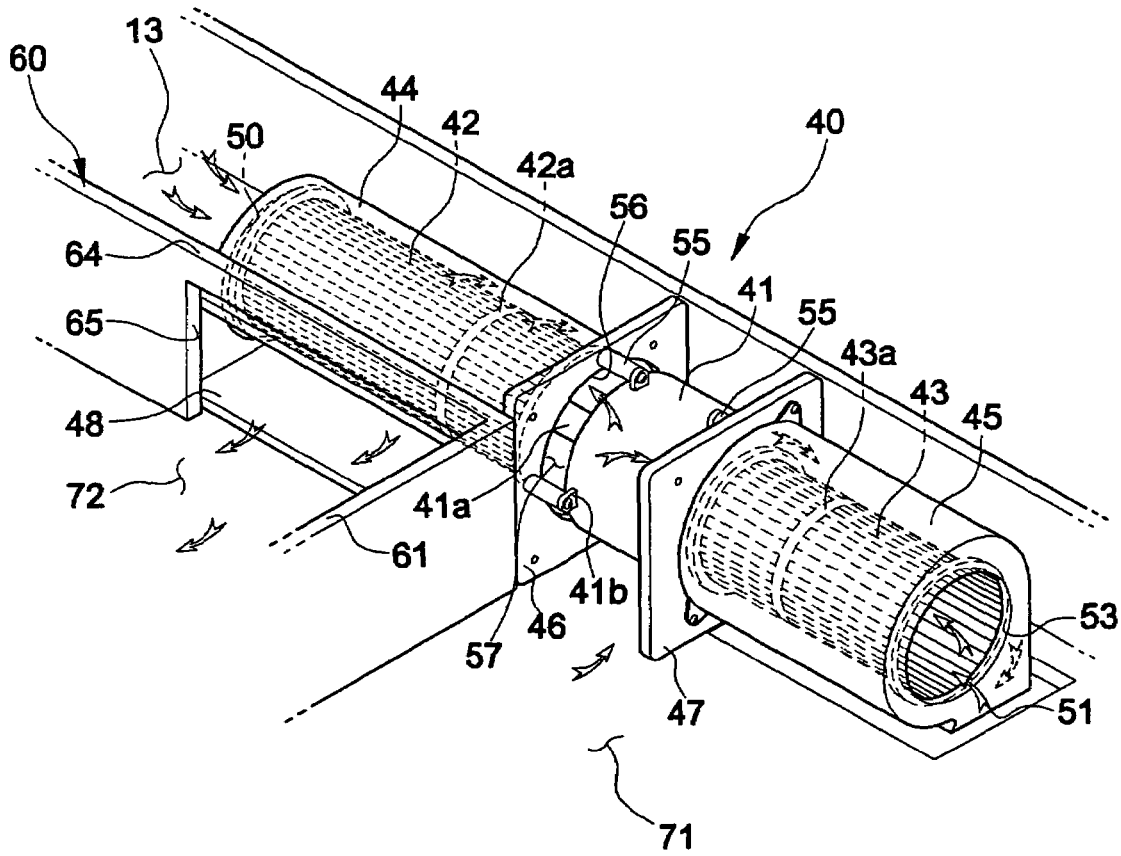
FIG. 2 is an enlarged partial perspective view of an exhaust and cooling unit of FIG. 1, which is mounted between the exhaust path and the cooling path.
Figure 3:
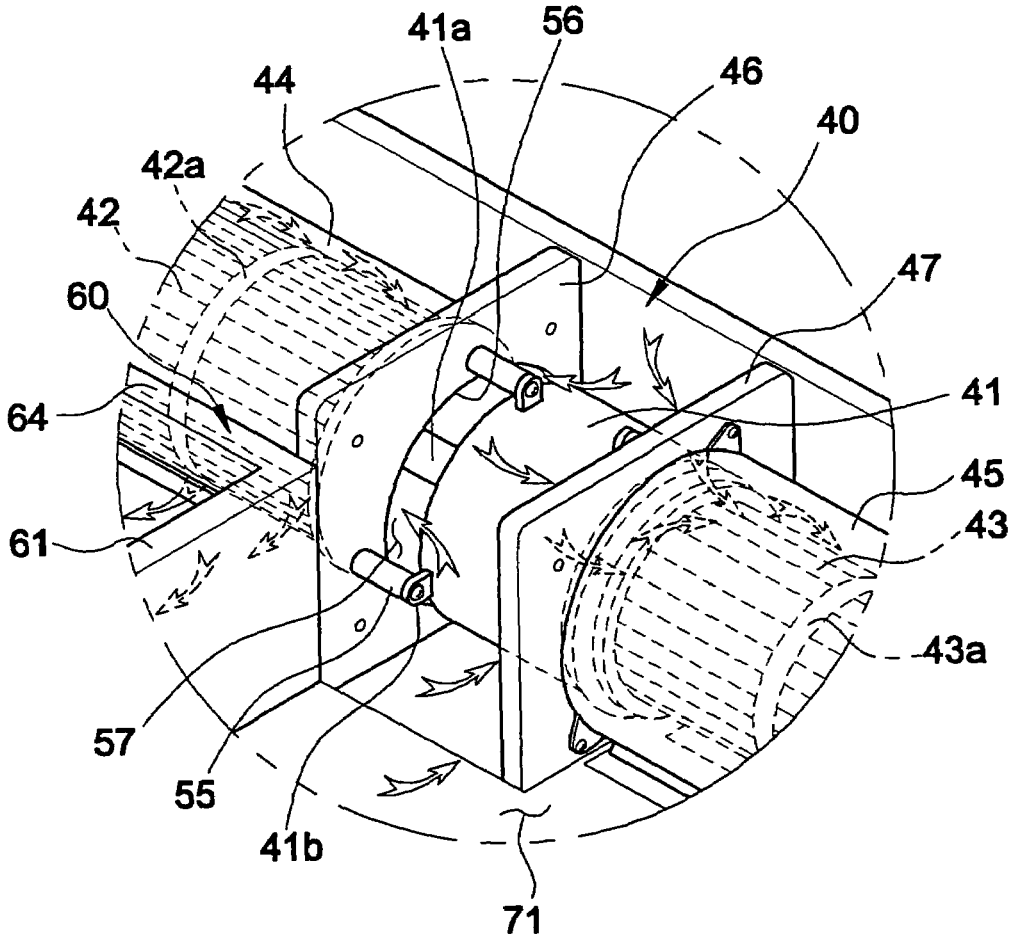
FIG. 3 is an enlarged perspective view of FIG. 2, in which air passes through the driving motor.

FIG. 2 is a partial perspective view of the exhaust and cooling unit 40 according to the embodiment of the present invention, which is mounted between the exhaust path 13 and the cooling path 71, and FIG. 3 is an enlarged partial perspective view of FIG. 2, in which air passes through the driving motor 41.

As shown in FIGS. 2 and 3, the exhaust and cooling unit 40 includes a cylindrical exhaust fan casing 44 to house the exhaust fan 42, a cylindrical cooling fan casing 45 to house the cooling fan 43, and first and second brackets 46 and 47 to hold the exhaust fan casing 44 and the cooling fan casing 45, respectively, in addition to the driving motor 41, the exhaust fan 42 and the cooling fan 43.

The first and second brackets 46 and 47 are provided with a plurality of bosses 55 projected therefrom, each of which projects toward the driving motor 41 and has a threaded hole therein. Each of the first and second brackets 46 and 47 includes an opening 56 at the center thereof, to allow the air that reaches the driving motor 41 to be introduced to the exhaust fan 42 or the cooling fan 43.

The driving motor 41 is provided with a plurality of lugs 41*b* at opposite ends of an outer surface thereof, corresponding to the bosses 55 of the first and second brackets 46 and 47. Each of the lugs 41*b* has a screw hole to align with the threaded hole of a corresponding boss 55. Thus, when screws are tightened into the treaded holes of the bosses 55 through the screw holes of the lugs 41*b*, the driving motor 41 is firmly held on the first and second brackets 46 and 47, and annular gaps 57 are defined between the opposite ends of the driving motor 41 and circumferential edges of the openings 56 of the first and second brackets 46 and 47, respectively.

The exhaust fan 42 and the cooling fan 43 couple to rotating shafts 41*a* projecting from the opposite ends of the driving motor 41. Each of the exhaust fan 42 and of the cooling fan 43 includes a cylindrical body and a plurality of blades radially arranged on the cylindrical body, and is divided into two fan parts by a dividing plate 42*a* or 43*a* circumferentially positioned on the exhaust fan 42 or the cooling fan 43, to draw air which is used to cool the driving motor 41.

The cylindrical exhaust fan casing 44 and the cylindrical cooling fan casing 45 include inlets 50 and 53, respectively, to allow air to be drawn therethrough, include outlets 48 and 51, respectively, to allow the air to be discharged therethrough, and are fixed to outer surfaces of the first and second brackets 46 and 47, respectively.

The exhaust and cooling unit 40 is configured on the box-shaped oven cabinet 10 such that the driving motor 41 and the cooling fan 43 are isolated from the exhaust fan 42 by the first partition plate 61 of the guide unit 60.

The driving motor 41 including the cooling fan 43 is disposed to face the air inlet 20, and directly communicates with the air inlet 20 through the cooling path 71 which has a large width to allow sufficient air to cool the driving motor 41 without a need to provide an enlarged driving motor.

With the guide unit 60 and the exhaust and cooling unit 40, when the driving motor 41 operates, the exhaust fan 42 and the cooling fan 43 rotate, and, thus, air is drawn into the cooling path 71 through the air inlet 20. The air drawn into the cooling path 71 passes through the annular gaps 57 and the openings 56 of the first and second brackets 46 and 47 while cooling the driving motor 41, and is discharged from the outlets 48 and 51 of the exhaust fan 42 and the cooling fan 43, respectively.

A portion of the air, drawn through the air inlet 20, is directed to the cooling fan casing 45 by the cooling path 71, and is introduced into the electrical component compartment 12 through the inlet 53 and the outlet 51 of the cooling fan casing 45 where the air cools the electrical components such as the magnetron 17. Subsequently, the air in the electrical component compartment 12 is transferred to the cooking chamber 11 through the through-holes 23, and is discharged from the air outlet 21 through the plurality of through-holes 24.

The air, which is discharged from the outlet 51 of the cooling fan casing 45 after passing through the driving motor 41, is mixed with the air, which is discharged from the outlet 51 through the inlet 53 of the cooling fan casing 45, and the mixed air is discharged from the air outlet 21. The air, which is discharged from the outlet 48 of the exhaust fan casing 44 after passing through the driving motor 41, is discharged from the exhaust outlet 22 through the exhaust path 72.

A wall mounted type microwave oven is provided in which a driving motor to rotate an exhaust fan and a cooling fan directly communicates with an air inlet together with the cooling fan. A guide unit allows the direct communication and includes a partition plate extending from between an exhaust outlet and the air inlet to between the exhaust fan and the driving motor to efficiently cool the driving motor. Thus, since the driving motor is resistant to heat, compared to a conventional driving motor, a life span of the driving motor is extendable, and a volume of the driving motor is reducible.

Although an embodiment of the present invention has been shown and described, it would be appreciated by those skilled in the art that changes may be made in the embodiment without departing from the principles and spirit of the invention, the scope of which is defined in the claims and their equivalents.

What is claimed is:

1. A wall mounted type microwave oven, comprising:

an oven cabinet with an exhaust path;

a driving motor disposed at an upper portion of the oven cabinet;

an exhaust fan coupled to a first end of the driving motor and disposed in the exhaust path;

a cooling fan coupled to a second end of the driving motor;

an exhaust outlet disposed to the upper portion of the oven cabinet to allow exhaust gas discharged from the exhaust fan to be discharged to an outside of the oven cabinet;

an air inlet disposed to the upper portion of the oven cabinet to allow air to be drawn to the cooling fan; and a guide unit to isolate the exhaust fan and the exhaust outlet from the cooling fan and the air inlet, and to position the driving motor and the cooling fan at an air inlet side.

2. The wall mounted type microwave oven as set forth in claim 1, wherein the guide unit comprises:

a first partition plate extending from between the air inlet and the exhaust outlet to between the driving motor and the exhaust fan to define a cooling path communicating the air inlet with the driving motor and the cooling fan and to define an exhaust path communicating the exhaust outlet with the exhaust fan.

3. The wall mounted type microwave oven as set forth in claim 2, wherein the air inlet is positioned at one side of the exhaust outlet while the air outlet is positioned at another side of the exhaust outlet.

4. The wall mounted type microwave oven as set forth in claim 3, wherein the guide unit further comprises:

a rear plate extending from a rear end of the first partition plate toward a side panel of the oven cabinet adjacent to the exhaust path;

a second partition plate extending from between the air outlet and the exhaust outlet to the rear plate; and a third partition plate extending from between the exhaust path and the air outlet to the rear plate.

5. The wall mounted type microwave oven as set forth in claim 4, wherein the rear plate comprises:

an opening at a region corresponding to the exhaust fan, to allow the exhaust gas discharged from the exhaust fan to be directed to the exhaust outlet.

6. The wall mounted type microwave oven as set forth in claim 2, further comprising:

first and second brackets provided at opposite ends of the driving motor, each of which has a plurality of bosses extending toward the driving motor, each of the bosses having a threaded hole, and wherein the driving motor comprises:

a plurality of screw holes at an outer surface thereof, each of which align with a corresponding one of threaded holes of the bosses, and through each of which a screw is fastened into the corresponding one of the threaded holes of the bosses of the first and second brackets to space the first and second brackets from the driving motor by predetermined intervals.

7. The wall mounted type microwave oven as set forth in claim 6, further comprising;

a first casing surrounding the exhaust fan and a second casing surrounding the cooling fan, which are secured to outer surfaces of the first and second brackets, respectively.

8. The wall mounted type microwave oven as set forth in claim 7, wherein each of the first and second brackets includes a center opening such that a gap is formed between an edge of the center opening and the driving motor, wherein during a rotation of the exhaust fan and the cooling fan, air is introduced into the exhaust fan and the cooling fan through the gaps while cooling the driving motor.

9. A wall mounted type microwave oven, comprising:

an oven cabinet with an exhaust path provided along a side panel thereof;

a driving motor disposed at a rear, upper portion of the oven cabinet;

an exhaust fan and a cooling fan coupling to opposite ends of the driving motor;

an exhaust outlet and an air inlet disposed to a front, upper portion of the oven cabinet to correspond to the exhaust fan and the cooling fan; and a guide unit disposed to the upper portion of the oven cabinet to allow the exhaust outlet to communicate with the exhaust fan and to allow the air inlet to communicate with the driving motor and the cooling fan and directing air drawn through the air inlet toward the driving motor.

10. The wall mounted type microwave oven as set forth in claim 9, wherein the guide unit comprises:

a first partition plate extending from between the air inlet and the exhaust outlet to between the driving motor and the exhaust fan to define a cooling path allowing the air inlet to communicate with the driving motor and the cooling fan.

11. The wall mounted type microwave oven as set forth in claim 10, wherein the guide unit further comprises:

a rear plate extending from a rear end of the first partition plate toward the side panel of the oven cabinet adjacent to the exhaust path;

a second partition plate extending from between the air outlet and the exhaust outlet to the rear plate; and a third partition plate extending from between the exhaust path and the air outlet to the rear plate.

12. A wall mounted type microwave oven having an oven cabinet and a driving motor disposed therein, comprising:

first and second fans coupled to respective opposite ends of the driving motor;

an inlet and an outlet communicating with the first and second fans, respectively, to move air into and out of the oven cabinet; and a guide unit to separate an air outlet side and an air inlet side of the oven cabinet from each other, and to position one or more of the driving motor, of the first and second fans on the air inlet side of oven cabinet.

13. The wall mounted type microwave oven as set forth in claim 12, wherein the guide unit comprises:

a first divider extending from between the inlet and the outlet to between the driving motor and a respective one of the first and second fans to define a first path to connect the inlet with the driving motor and the respective one of the first and second fans and to define a second path to connect the outlet with the remaining one of the first and second fans.

14. A wall mounted type microwave oven having an oven cabinet and a driving motor disposed therein, comprising:

a cooling unit and an exhaust unit to move air into and out of the oven cabinet, respectively, the driving motor driving the exhaust and cooling units; and a guide unit to separate an exhaust unit side and a cooling unit side of the oven cabinet from each other, and to position the driving motor on the cooling unit side of oven cabinet.

15. The wall mounted type microwave oven as set forth in claim 14, further comprising:

a first bracket to couple the cooling unit to the drive motor;

a second bracket to couple the exhaust unit to the drive motor; and first and second covers encasing the exhaust and cooling units, respectively, the first and second covers being secured to outer surfaces of the first and second brackets, respectively.

16. The wall mounted type microwave oven as set forth in claim 15, wherein each of the first and second brackets includes an opening to form an annular gap between the drive motor and respective first and second brackets such that air is introduced into the exhaust and cooling units through the openings and cools the driving motor.

* * * * *